US005701629A

United States Patent [19]

O'Brien

[11] Patent Number: 5,701,629

[45] Date of Patent: Dec. 30, 1997

[54] HOLLOW BRUSH BRISTLE WITH RADIATING SPOKES

[75] Inventor: Timothy D. O'Brien, Crofton, Md.

[73] Assignee: Speciality Filaments, Inc., Wilmington, Del.

[21] Appl. No.: 504,114

[22] Filed: Jul. 19, 1995

[51] Int. Cl.[6] ..... D02G 3/00; A46B 15/00

[52] U.S. Cl. ..... 15/207.2; 428/397; 428/398; 15/159.1

[58] Field of Search ..... 15/207.2, 159.1, 15/DIG. 6; 428/398, 397

[56] References Cited

U.S. PATENT DOCUMENTS

| | | | |
|---|---|---|---|
| 2,433,325 | 12/1947 | Slaughter | 15/207.2 |
| 2,637,893 | 5/1953 | Shaw . | |
| 3,121,040 | 2/1964 | Shaw et al. . | |
| 3,344,457 | 10/1967 | Grobert . | |
| 3,605,162 | 9/1971 | Long | 15/207.2 |
| 3,981,948 | 9/1976 | Phillips . | |
| 4,307,478 | 12/1981 | Ward et al. | 15/207.2 |
| 4,364,996 | 12/1982 | Sugiyama | 428/398 |
| 4,559,268 | 12/1985 | Nakashima et al. . | |
| 4,621,022 | 11/1986 | Kohaut et al. | 428/397 |
| 4,956,237 | 9/1990 | Samuelson | 428/398 |
| 5,322,736 | 6/1994 | Boyle et al. | 428/398 |

*Primary Examiner*—Timothy F. Simone
*Assistant Examiner*—Tony G. Soohoo
*Attorney, Agent, or Firm*—Browdy and Neimark

[57] ABSTRACT

A polymer bristle (100) for a liquid-applying brush such as a paint brush includes in cross section a central bore (95), an annulus (96) and preferably three radiating spokes (97) with parallel sides and rounded tips. The bristle is tapered from a thick end (101) that is bundled into the ferrule of a brush toward a thin end (103). The bristle may be flagged by slits (130).

20 Claims, 3 Drawing Sheets

HOLLOW BRUSH BRISTLE WITH RADIATING SPOKES

FIELD OF THE INVENTION

The present invention relates to synthetic plastic filaments as bristles for brushes, especially applicator brushes, most especially paint brushes, and application brushes made therefrom.

BACKGROUND OF THE INVENTION

Paint brushes are now typically made with artificial bristles of polymers, extruded from nozzles, which perform better than their natural prototypes, animal bristles. While such brushes may be made with level, i.e untapered, round bristle fibers, such brushes are lacking in several respects. First, a brush should have a "snap-back" quality, with bristles stiffer at the base near the brush ferrule and handle than at the tip (but some level bristles lack this property); second, the brush should have the maximum surface area to be wetted by, and thus hold, paint (but cylindrical bristles have instead the minimum wetted area per unit of bristle volume); third, the bristles should be spaced slightly to increase the amount of paint that is held between them (but round-cross-section bristles are tightly packed in the ferrule); and fourth, the bristles should be individually stiff so that they can be fine (to increase the surface area) while still keeping the brush as a whole sufficiently stiff (but plain round bristles are not as stiff as other shapes).

The Nakashima U.S. Pat. No. 4,559,268 discloses thermoplastic polymer paintbrush bristles, said to provide excellent stiffness and cleanability, having a cross-section generally in the form of a FIG. 8. The background section of this patent mentions that "disadvantageous" synthetic paintbrush bristles, tapered or processed at their ends, are currently available in such cross-sections as circular, elliptic, triangular, Y-shaped, flat, cruciform, modified cruciform, three-leafed, four-leafed, cogwheel-shaped, circularly hollow and porously hollow.

Grobert U.S. Pat. No. 3,344,457 shows synthetic paintbrush bristles of various cross-sections including trilobal and tetralobal or cruciform. These bristles also do not have a circular cross-section, and moreover are not hollow. Also see Shaw et al U.S. Pat. No. 3,121,040 and Shaw U.S. Pat. No. 2,637,893 which further show synthetic brush bristles of a trilobal and cruciform cross-sectional configuration, as well as other shapes. An early patent in this field is Slaughter U.S. Pat. No. 2,433,325 which shows tapered and level paintbrush bristles of varying cross-sections.

Ward, in U.S. Pat. No. 4,307,478 discloses a hollow tapered brush bristle having a "neck-down" (column 2, line 52) region along the bristle where the rate of taper is greatest. Ward does not disclose arms or spokes.

A number of fiber cross-sections which are suitable for insulation, textile and/or carpet fibers have been proposed, which fibers are fully suitable for those uses but are not suitable for brush bristles, especially paintbrush bristles. For example, non-circular fibers are more bulky, which is advantageous for insulation, textile and carpet fibers. Also, certain configurations imparted to monofilaments cause the filaments to curl so that, if the monofilament is cut to bristle length, e.g. one inch to six inches for a paint-brush, opposite ends of the monofilament will not line up parallel to the length of the brush. It will also be understood that brush bristles are generally much greater in thickness than insulation, textile and carpet fibers, i.e. they have much greater denier and cross-sectional area, and variations which are tolerable in insulation, textile and carpet fibers (indeed beneficial in some respects such as bulkiness) cannot be tolerated for brush bristles.

Samuelson, in U.S. Pat. No. 4,956,237, discloses a spinneret for making hollow insulation fibers with arcuately-extending radiating arms (FIG. 7). The arms increase the loft of insulation made from the fibers. The radiating arms, being curved, are not suitable for brushes as the curved arms will interlock. Sugiyama, U.S. Pat. No. 4,364,996, also discloses an insulation fiber which includes three projecting arms (FIG. 1B), along with specific physical characteristics adapted to use as "down-like" insulation.

Long, in U.S. Pat. No. 3,605,162, discloses a brush intended for use in car washes, whose bristles are hollow and circular and include short triangular ribs 14 extending outwardly from its outer surface. Long teaches that these ribs have a height related to the fiber diameter (column 3, lines 28–42) by the condition that the cross section can be inscribed into a regular polygon, with the ends of the ribs intersecting a tangent to the circular wall surface of the bristle. For example, if there are four ribs, these are short enough that tangent lines to the outer circular surface intersect adjacent triangle tips, i.e. the bristle's cross-section can be inscribed into a square with the rib tips in the corners and the circular portion touching the sides of the square (FIG. 1).

Long mentions, as one prior-art approach, bristles having X- or Y-shaped cross sections, which have a "substantial amount of the material of the cross section extending outwardly from the axis of the filament". Long teaches against these X, Y type brushes bristles (column 1, line 67 to column 2, line 3) as causing entanglements.

Long's bristles, particularly designed and constructed only for car washing, are not flagged (split at the ends). Long teaches against flagging, disclosing (column 4, line 45 et seq) stretching the fibers by a draw ratio of 5.5 times which, with the α-olefin material employed by Long, only slightly orients the molecules of the bristle. The partial molecular orientation prevents "splitting or lamination of the filament which might produce fraying of ends of the filament during use [and lead to] possible catching on projections or irregularities on a surface being washed" (column 4, lines 56–62). Long nowhere discloses tapering, which would lead to greater molecular orientation at the bristle ends. Long is unconcerned with holding any material such as powder or paint in the brush or applying any such material, but is only concerned with bristles for scrubbing.

Insofar as is known, the prior art does not disclose any circular paint brush bristles with external ribs, (1) which provide overall bristle stiffness and variable stiffness along a length of each bristle, (2) which maximize surface area and bristle spacing for good paint or powder retention, and (3) which are adapted to flagging for smooth material application, or a group of such bristles bundled together such as in the form of an applicator brush.

SUMMARY OF THE INVENTION

Accordingly, the present invention has an object, among others, to overcome deficiencies in the prior art such as noted above.

It is another object of the invention to provide improved synthetic thermoplastic brush bristles, especially paintbrush bristles, and improved brushes made therefrom.

It is a further object of the present invention to provide improved brush bristles having a circular hollow cross-section with outwardly extending ribs or spokes, either in level (i.e. non-tapered) form or tapered form, which are improved as regards conventional circular cross-section brush bristles in that they are stiffer and less likely to collapse; which are better and more easily flagged to provide a better and more dispersed flag population at the free ends thereof with more surface area; and which because of their increased stiffness can be used in smaller diameters which in turn results in increased bristle density and better painting, i.e. better holding and release of paint and powders.

These and other objects of the present invention are achieved by providing a monofilamentary hollow applicator brush bristle, either level or tapered such as in accordance with Ward et al U.S. Pat. No. 4,307,478, the contents of which are hereby incorporated by reference, which bristle has a substantially circular cross-section with large outwardly extending spokes or fins of substantially rectangular cross-section having rounded outer corners, and which bristle only has one seam along its length. The large spokes provide increased surface area for better material (e.g. paint and powder) retention and application.

A brush made of these bristles maximizes paint and powder holding power, while at the same time these bristles provide the correct brush stiffness characteristics and tip flow characteristics. Such an applicator brush has better bulk density characteristics with less weight, better fill with fewer bristles and without loss of paint carrying capacity or of quality of paint application.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

The following definitions apply:

"applicating end" means the end of a bristle or brush from which paint or powder flows onto a surface when applying paint or powder with the brush;

"ferrule end" means the end of a bristle or brush distal the applicating end, at which the bristles are bundled or attached to a handle or other brush-manipulating structure; and "flagged" means having applicating ends frayed, split, or lengthwise separated.

Figure 1:
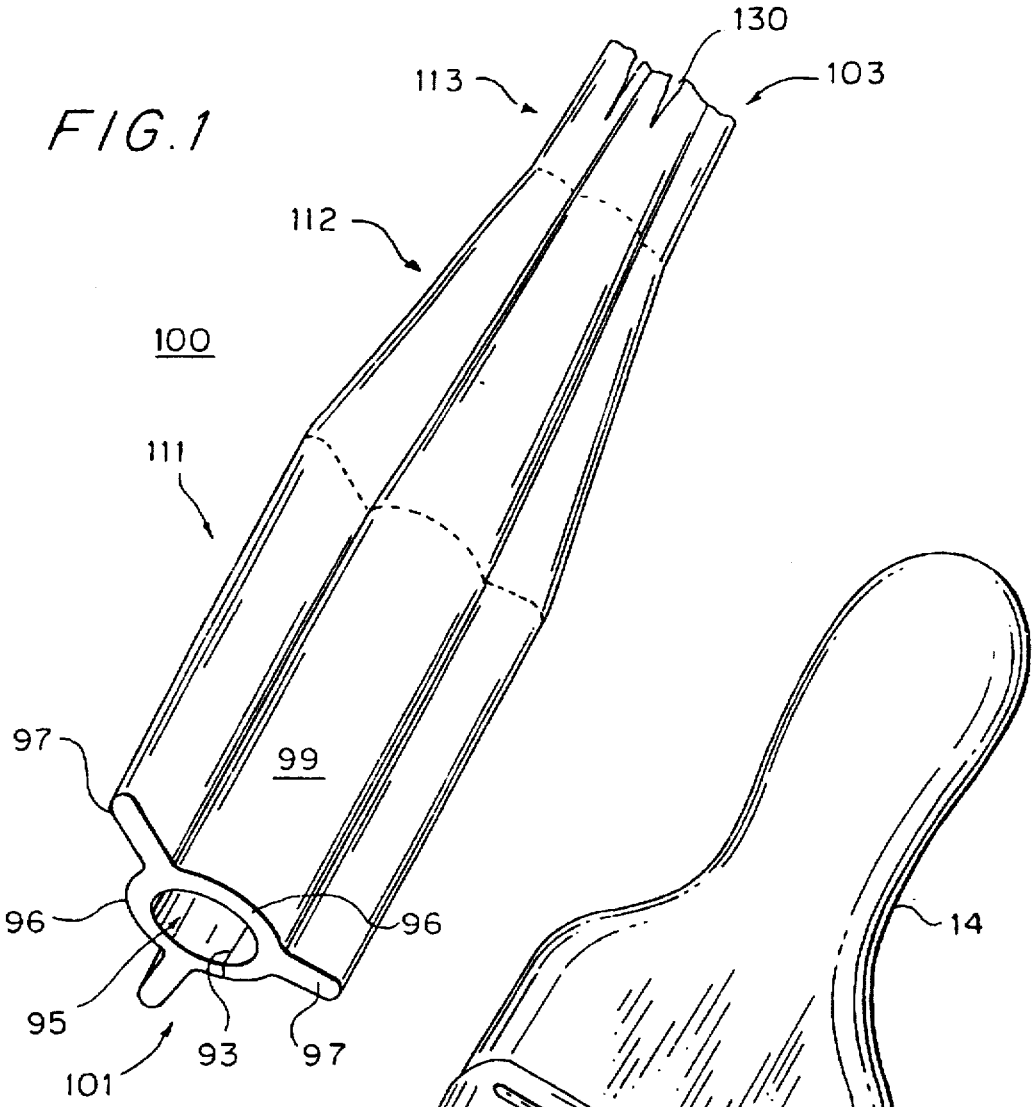
FIG. 1 is a schematic perspective view of a tapered bristle of the invention.
Figure 2:
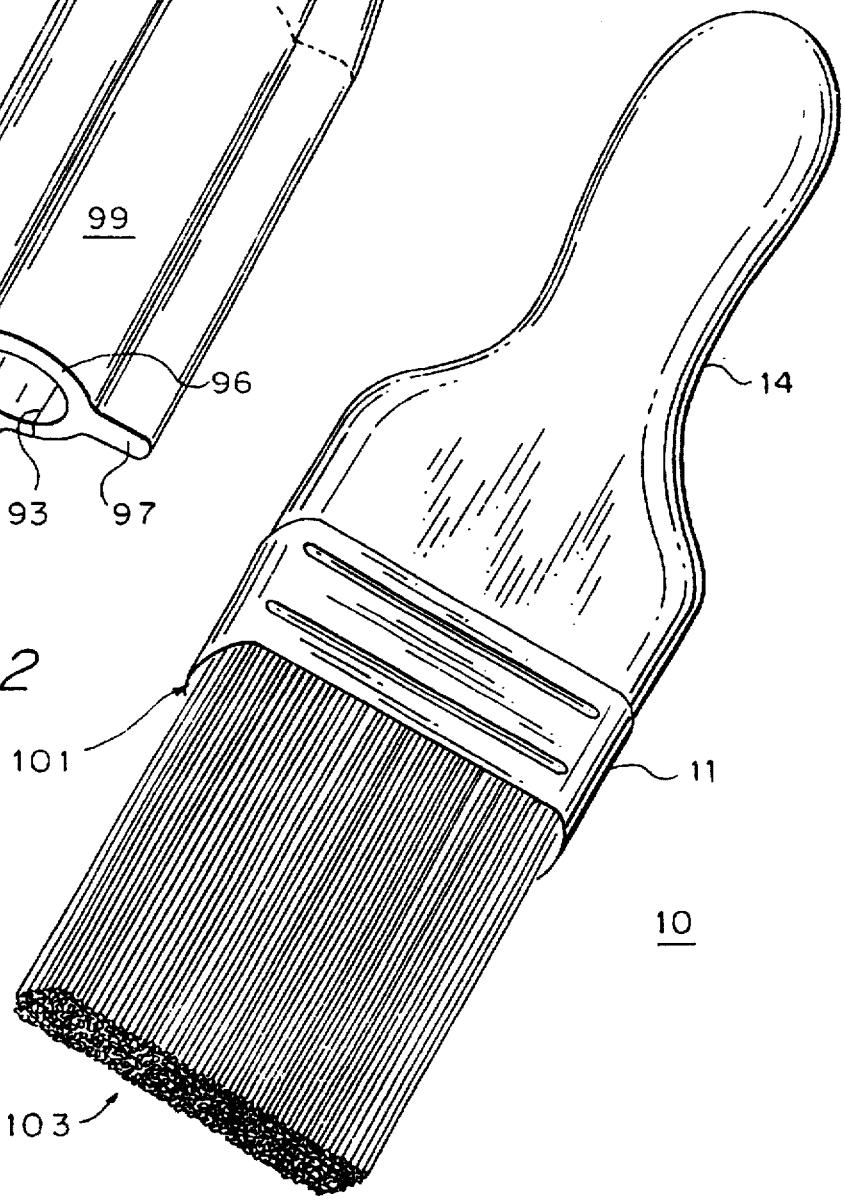
FIG. 2 is a perspective view of a brush incorporating the bristles of the invention.

The present invention relates to brushes, such as paint brushes, used for applying paints or powders to surfaces, and to bristles used for such brushes. FIG. 1 shows a tapered bristle 100 according to the present invention, and FIG. 2 shows a paint brush 10 incorporating the bristles 100.

The bristle 100 of FIG. 1 is straight (not crimped in any way), has a denier of 32 to 2500, and is made of a thermoplastic polymer, such as polyester or nylon. The monofilament from which the bristle is made may be extruded in the conventional manner from a spinneret (not shown) of the type shown in FIG. 4 of the aforementioned Ward et al U.S. Pat. No. 4,307,478, except having three equally spaced, outwardly projecting slots for forming the ribs or spokes 97. It is drawn from the spinneret in the usual way to control the thickness of the bristle 100.

It will be understood that the polymer being extruded or spun through the spinneret openings will initially exist in a C-shape, with the ends of the C welding together immediately downstream of the spinneret. Such a die configuration results in only one external seam 93 along the length of the resultant monofilament bristle 100, this seam being along the aforementioned weld line; while it will be understood that weld lines or seams are lines of weakness, the monofilament bristles 100 according to the present invention have only one such external weld line, which is an improvement over many synthetic applicator bristles of the prior art, and consequently are less subject to fracture longitudinally than are such prior art bristles.

In FIG. 1, three thickness regions are shown for a tapered bristle. Near a ferrule end 101 is a thick region 111 of greater cross section, and near an applicating end 103 is a thin region of lesser cross section. In between is an intermediate transition or "neck-down" region 112. The drawing FIG. 1 exaggerates the abruptness of the transition, and shows for clarity distinct or sharp borders between the regions 111, 112, and 113. The actual bristle of the present invention may be somewhat more smoothly tapered rather than "bottle-shaped" as shown in the drawing, and the relative sizes of the portions may be different in various embodiments from that shown.

In FIG. 2 a plurality of the bristle 100 are shown bundled and attached to a handle 14 that includes a ferrule 11, into which portions of the thick region 111 of each bristle 100 (adjacent the ferrule end 101 of each respective bristle) are fastened. The applicating ends 103 of the bristles are distal the handle 15. Level, i.e. non-tapered, bristles are also suitable for use in applicator brushes according to the present invention. In alternative embodiments, the ferrule 11 may be omitted or replaced by other means for holding the bristles 100 in a bundle, and, the handle 14 may be replaced by some other brush manipulator such as a roller, robot arm, holder core, etc.

FIG. 1 shows, at the ferrule end 101, a cross section of the bristle 100. The cross section includes a generally cylindrical central bore 95 which runs throughout the length of the bristle 100. Around the bore 95 is an annulus 96 constituting the body of the bristle 100, and defined by the bore 95 and an outer generally circular surface 99 that is concentric with the bore 95; the circularity of the outer surface 99 is interrupted by the spokes or ribs 97 extending radially outward from the outer surface of the annulus 96. Each spoke or rib 97 includes two generally parallel sides and a generally rounded tip distal the annulus 96. The spoke 97 is thus substantially rectangular with rounded distal corners and not triangular in cross section.

The height of the spokes or fins 97 is an important feature of the invention. These spokes must extend outwardly from the outer circular wall 99 a distance which is at least as great as the radius of the bore 95, and preferably the spokes have a height which approaches the outer annulus radius but is no greater than the outer annulus radius. If the spokes or fins 97 are of insufficient height, the bulk density characteristics and paint retention are insufficiently improved; but if the spokes 97 extend outwardly too far, the bristles tend to interlock and thus interfere with one another when assembled in brush form. If is also important that the spokes or fins 97 be straight in the longitudinal and axial directions, as spokes curved in the radial direction tend to catch the material to be applied, e.g. paint, without good release, and spokes curved in the longitudinal direction tend to interlock.

Exemplary preferred dimensions at the thick region 111 of the bristle 100, in mils or thousandths of an inch, are: bore diameter, 4.9; spoke thickness, 3.0; spoke height or extension distance from the annulus, 4.4; and outer annulus radius, 9.9. The wall thickness of the annulus is therefore about 2.5 mils. Considering the cross-sectional area of the annulus 96 and the central bore 95, the former comprises 74.1% and the latter 25.9%. This exemplary embodiment has a denier measurement of 512d, equivalent to a solid cross-section round fiber 0.009" in diameter. A solid round monofilament of the same outside diameter, i.e. 0.0099" would have a denier of 629.

If used in the manufacture of a paintbrush 10, the level or tapered bristles 100 of the present invention are suitably of any selected length from about one inch to about six inches, depending on the desired length of the bristle portion of the resultant paintbrush 10. For other types of brushes, other lengths may be desirable. In general, the ribbed bristles 100 according to the present invention have an outer diameter of 2–20 mils. In the case of the tapered bristle 100, the minimum outer diameter measured to the outer wall 99 at the tip portion 12 should be no less than about 4 mils, whereas the maximum diameter to the outer wall 99 at the butt portion 14 should be no greater than about 20 mils.

The ribbed hollow bristles 100 of the present invention may be formed of any of a variety of polymers, including polyesters, polyamides (nylons), polyolefins and blends of such polymers. Preferred materials are nylons and polyesters, most especially polybutylene terephthalate (PBT), polyethylene terephthalate (PET), nylon 6,10 and nylon 6,12.

In manufacturing the tapered bristles 100, the monofilament extrudates may be drawn while being extruded so that the molecules of the polymer are oriented. A draw ratio of 3.5 to 5 is preferred with polyester or nylon. The tapered bristles may be produced by the methods outlined by Ward et al in U.S. Pat. No. 4,307,478, so that when the bristles 100 are assembled into the ferrule 11 their respective thick regions 111 and thin regions 113 may be mutually aligned.

The rate of throughput of the polymer through the spinneret opening is dependent on a variety of factors, including the polymer being extruded, the distance of the spinneret plate from the quench bath, the size of the spinneret orifices and the number of such orifices. Spinnerets commonly have from 50 to 800 orifices. Depending on the above factors, the throughput rate on a 1.5 inch extruder will range between the values 15 and 100 lbs/hour.

The equipment used for stretching or drawings the monofilaments leaving the spinneretes to form the level bristle is the same equipment which is traditionally used in the manufacture of level brush bristles. Similarly, the equipment used for stretching and tapering the monofilaments leaving the extruder in order to form the tapered bristle 100 is the same equipment which is traditionally used in the manufacture of tapered brush bristles. In the conventional way, the molten polymer is spun from the spinnerets into a water quench bath at 70°–95° F. located at a distance of ⅛ to 15/16 inch from the face of the spinneret, and the hollow-spun continuous monofilaments are pulled from the spinneret to provide the desired and typical degree of draw-down, such draw-down being variable in the case of manufacturing tapered bristles 100 and being at a constant rate to provide level bristles. Following the hot draw is an orientation stage during which the monofilaments are further drawn to a draw ratio of 3:1 to 4:1, prior to being annealed, and then cut to the desired bristle length.

Orienting the molecules by proper drawing increases the stiffness of the bristles 100, which is desirable. The molecules of the polymer should preferably be fully oriented in the thin region 113, so that the ends 103 of bristles may be easily flagged (split lengthwise). Flagged splits 130 are shown in FIG. 1. Flagging at the tip increases the wetted surface area, decreases stiffness at the tip, and reduces the average bristle fiber diameter at the tip, all of which are advantageous where the paint or other material to be applied is to be flowed onto a surface.

The tapered bristles 100 are most stiff near the ferrule end 101 and least stiff near the applicating end 103, due to thinner cross section and also flagging.

The radiating spokes of the bristle 100 are useful not only for stiffening the bristles 100 and increasing their wetted surface area to better hold paint or powder in the brush 10; they also serve to increase the average spacing of the bundled bristles 100 in the brush 10 when the ferrule ends 101 are gathered and glued (or otherwise fastened) to the brush handle 14. This provides a yield advantage to the brush maker, and reduces the overall cost.

Figure 3:
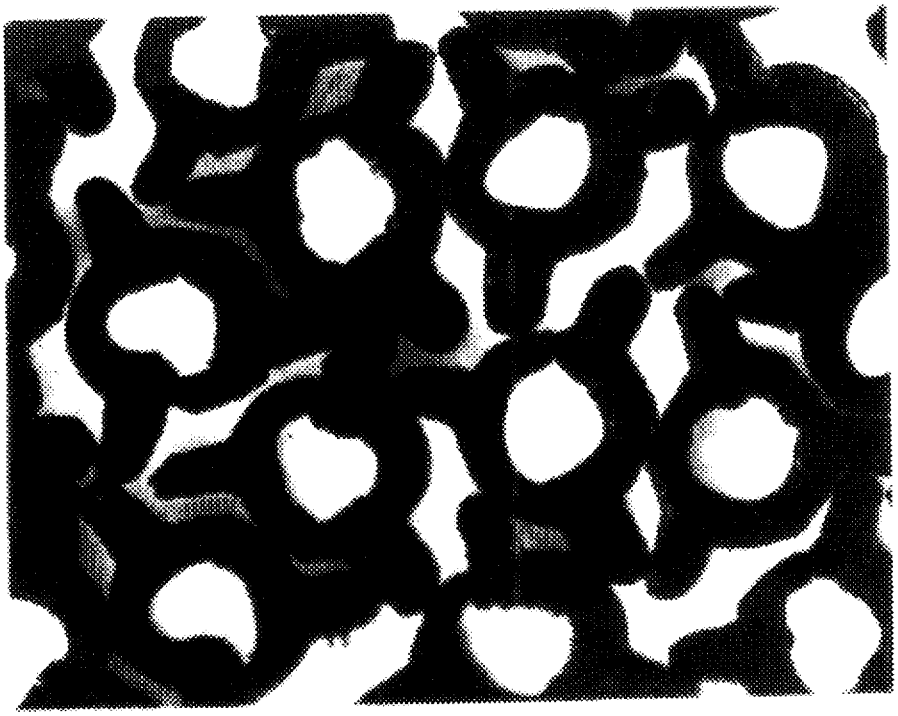
FIG. 3 is a photographic enlarged view of bristles bundled, as in a brush ferrule.

FIG. 3 is a view taken from a photograph of a plurality of the bristles 100 of the present invention, bundled together. As can be seen in the figure, most of the annuli 96 are not in contact with at least one adjoining annulus; this is due to the radiating spokes 97 which, despite some interdigitation, prevent contact between most neighboring pairs of annuli 96. Thus, the spokes 97 increase the average spacing of the bristles 100 as compared to bristles having a simple rounded outer surface.

The presence of the radiating spokes substantially decreases the number of bristles per unit, while simultaneously increasing the bristle stiffness. The brush of the present invention thus needs fewer bristles, as compared to prior art brushes, to achieve the desired overall brush stiffness, and without loss of holding capacity. Thus, the fewer bristles do not reduce the amount of paint or powder that the brush 10 can hold in the bristles 100. The material to be applied fills the interstices, and in fact the amount of such materials held is increased, because the bristles themselves take up less volume. Thus, the radiating spokes 97 decrease the amount of plastic needed, decreasing manufacturing costs, while at the same time increasing the amount of paint held and so the brush's painting efficiency.

The preferred number of ribs 97 is three per bristle, and these are preferably spaced 120° from one another as shown. No more than four ribs may be present as more than four ribs requires a spacing of less than 90° which causes undesirable interlocking of ribs of adjacent bristles.

Moreover, more than four ribs 97 would add little to the stiffness and would detract from the paint-holding ability; because the bristles 100 are small, paint will fill in between them; their wetted surface area is thus less important than the volume between the ribs in determining the liquid holding ability of the brush. Also, with more than three ribs the grooves between ribs becomes increasingly small and the brush becomes more difficult to clean of materials to be applied, such as paint which has begun to harden.

On the other hand, using only two ribs per bristle would substantially lower the stiffness of each bristle, as there would be no ribs 97 to act as stiffening ribs to resist bending across the plane of the two ribs. At the same time, use of only two ribs per bristle would increase the bundle packing density of the bristles 100 and so lower the liquid-holding ability and increase the number of bristles required per brush.

Figure 4:
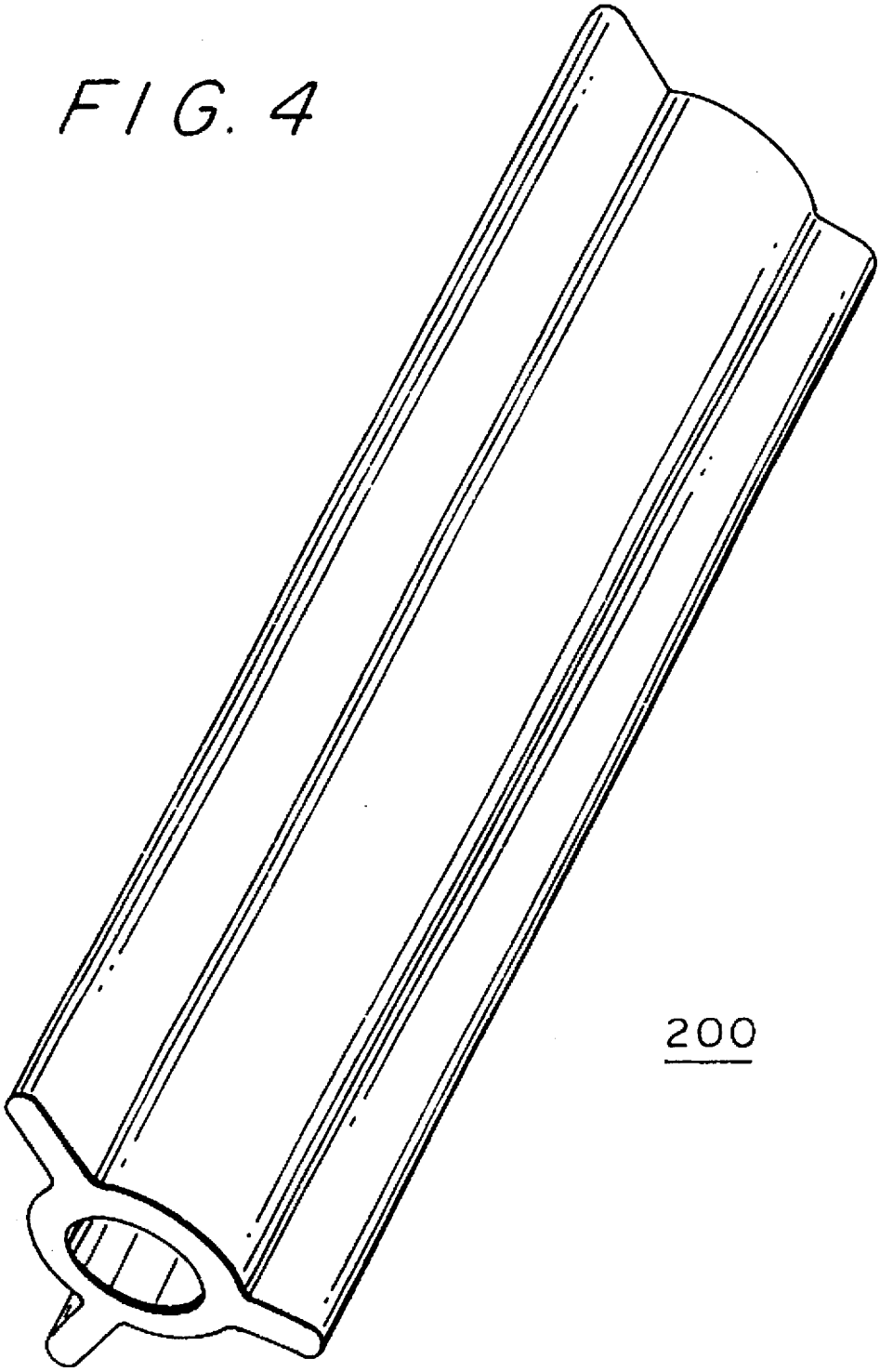
FIG. 4 is a schematic perspective view of a level bristle of the present invention.

FIG. 4 illustrates a level bristle 200 which is otherwise similar to the tapered bristle 100 of FIG. 1, except that it is not tapered.

The following examples will further illustrate the manner in which the present invention can be practiced, it being understood that these examples are merely illustrative and not limitative.

EXAMPLE 1

To make tapered, hollow ribbed bristles 100 having a butt end diameter of 12 mils and a tip end diameter of 8 mils, a spinneret plate having 150 spinneret apertures is provided with the outer diameter (forming the outer wall 99) of each spinneret being 42 mils. The spinneret is placed on a 1.5 inch extruder and black polybutylene terephthalate is extruded at a rate of 55 lbs. per hour through the spinnerets and into a water quench bath at 85° F. provided 7/16 inches below the spinneret face. The spun hollow ribbed monofilaments are drawn from the spinneret face at an average draw rate of 2:1, such as to provide 0 draw at the butt end (1:1) and 3:1 at the tip end; the length of each draw sequence is established to provide, after orientation, a bristle length of 4.75 inches. The resultant monofilaments are then passed to an orientation stage where they are further drawn 3.8:1, after which they are annealed and then cut to length.

EXAMPLE 2

Level hollow ribbed bristles 200 having an outer diameter of 9 mils to the outer wall 99 are formed by extruding nylon 6,12 through the same extruder described above in Example. The spun hollow monofilaments are drawn from the spinneret face at a consistent draw rate of 2:1, and then passed to an orientation stage where they are further drawn 4:1, and then annealed and cut to a bristle length of 4 inches.

Bristles made according to Examples 1 and 2 are highly uniform, have consistent cross-sections along their length, and are strong and stiff. These ribbed hollow bristles are easily flagged at their tip ends so as to make superior paintbrushes.

Brushes of a variety of types can be made using the present hollow ribbed level and tapered bristles 200, 100, whether level or tapered. These bristles are particularly suitable for paintbrushes 10 as illustrated in FIG. 2, having a typical handle 14 as shown. It is preferred that 100% of the present ribbed hollow bristles 100 and/or 200 be used to make such paintbrushes 10, but improved paintbrushes can be made using as little as 15% of such bristles in combination with up to 85% of other, e.g. conventional, bristles.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A brush bristle for an applicator brush, the brush bristle being formed of a polymer and being straight, having a denier of 32–2500 and having a length and a cross section taken across the length, the cross section comprising:

a generally circular central bore having a bore radius;

an annulus having an outer radius, said annulus surrounding the central bore; and a plurality of spokes extending outwardly from the annulus, each of said spokes including two substantially parallel sides and a rounded tip distal the annulus;

wherein the polymer is substantially oriented in a lengthwise direction, whereby the bristle is optionally flagged at an applicating end thereof; and wherein each of the spokes extends from the annulus a distance substantially equal to or greater than the bore radius and no greater than the outer radius of said annulus.

2. The bristle according to claim 1, wherein said plurality of spokes consists of exactly three spokes.

3. The bristle according to claim 1, wherein the polymer is polyester or nylon.

4. A brush bristle for an applicator brush, the brush bristle being formed of a polymer and being straight, having a denier of 32–2500 and having a length and a cross section taken across the length, the cross section comprising:

a generally circular central bore;

an annulus surrounding the central bore;

a plurality of spokes extending outwardly from the annulus, each of said spokes including two substantially parallel sides and a rounded tip distal the annulus;

wherein the polymer is substantially oriented in a lengthwise direction, whereby the bristle is optionally flagged at an applicating end thereof; and wherein the bristle is tapered.

5. The brush bristle according to claim 4, wherein said plurality of spokes consists of exactly three spokes.

6. The brush bristle according to claim 4, wherein the polymer is polyester or nylon.

7. A brush bristle for an applicator brush, the brush bristle being formed of a polymer and being straight, having a denier of 32–2500 and having a length and a cross section taken across the length, the cross section comprising:

a generally circular central bore;

an annulus having surrounding the central bore;

a plurality of spokes extending outwardly from the annulus, each of said spokes including two substantially parallel sides and a rounded tip distal the annulus, and wherein an applicating end thereof is flagged.

8. The brush bristle according to claim 7, wherein said plurality of spokes consists of exactly three spokes.

9. The brush bristle according to claim 7, wherein the polymer is polyester or nylon.

10. An applicator brush comprising:

a plurality of brush bristles formed of a polymer each having a ferrule end and an applicating end;

means for holding the plurality of brush bristles in a bundle; and means for manipulating the bundle;

at least 15% of the plurality of bristles being straight, having a denier of 32–2500 and a length and a cross section taken across the length, the cross section further comprising:

a generally circular central bore;

an annulus surrounding the central bore; and a plurality of spokes extending outwardly from the annulus, each of the spokes including two substantially parallel sides and a rounded tip distal the annulus;

wherein the polymer is substantially oriented in a lengthwise direction in at least a region of the brush bristle adjacent to an applicating end thereof, whereby the brush bristle optionally is flagged at the applicating end, and wherein said brush bristles are mutually spaced apart in the bundle by the spokes, such that the brush holds an increased quantity of material to be applied.

11. The brush according to claim 10, wherein the plurality of spokes consists of exactly three spokes.

12. The brush according to claim 10, wherein the bore has a bore radius and each of the spokes extends from the annulus a distance substantially equal to or greater than the bore radius and no greater than the radius of the annulus.

13. The brush according to claim 10, wherein the polymer is polyester or nylon.

14. The brush according to claim 10, wherein the bristles are tapered, with the ferrule end being larger than the applicating end.

15. The brush according to claim 10, wherein the applicating ends of said bristles are flagged.

16. In a plurality of monofilamentary brush bristles for association together to form an applicator brush, each bristle being straight and formed of a thermoplastic polymeric material, the improvement wherein:

each bristle has a substantially circular cross-section with an outer wall and an inner wall defining an internal hollow bore extending therethrough along the entire length thereof, and three spokes extending outwardly from and spaced 120° about said outer wall, each spoke being substantially rectangular with rounded distal corners, and each spoke having a height at least equal to the bore radius and no greater than the radius to said outer wall; said spokes constituting means for spacing said bristles in mutually spaced apart position such that in brush form, said bristles hold an increase quantity of material to be applied; and said bristles having a denier of 32–2500.

17. Brush bristles according to claim 16 which are tapered, and each of which has a minimum outer diameter at its narrow end of about 4 mils and a maximum outer diameter at its large end of about 20 mils.

18. Brush bristles according to claim 16 wherein said thermoplastic polymeric material is selected from the group consisting of polyester and nylon.

19. Brush bristles according to claim 16 which are flagged at one end thereof.

20. In a brush comprising a handle and a plurality of bristles extending from said handle, the improvement wherein said brush bristles consist of at least 15% of the bristles according to claim 16.

* * * * *